United States Patent [19]

Rennex

[11] Patent Number: 4,971,305

[45] Date of Patent: Nov. 20, 1990

[54] VARIABLE ADD-ON WEIGHT DEVICE

[76] Inventor: Brian G. Rennex, 431 Muddy Branch Rd., #101, Gaithersburg, Md. 20878

[21] Appl. No.: 304,444

[22] Filed: Jan. 31, 1989

[51] Int. Cl.[5] ..... A63B 21/062

[52] U.S. Cl. ..... 272/118; 272/123

[58] Field of Search ..... 272/117, 118, 122, 123, 272/116, 134, DIG. 4

[56] References Cited

U.S. PATENT DOCUMENTS

| | | | |
|---|---|---|---|
| 2,796,269 | 6/1957 | Watson | 272/123 X |
| 3,502,329 | 3/1970 | Brazier | 272/117 |
| 3,825,253 | 7/1974 | Speyer | 272/123 |
| 4,531,728 | 7/1985 | Wright | 272/122 |
| 4,610,449 | 9/1986 | Diercks, Jr. | 272/118 |
| 4,625,959 | 12/1986 | Schleffendorf | 272/118 |
| 4,743,017 | 5/1988 | Jaeger | 272/122 |
| 4,746,113 | 5/1988 | Kissel | 272/118 |
| 4,787,628 | 11/1988 | Harwick et al. | 272/118 |

*Primary Examiner*—Robert Bahr

*Attorney, Agent, or Firm*—Lowe, Price, LeBlanc, Becker & Shur

[57] ABSTRACT

This invention is a device which enables weight trainers to more conveniently select a particular weight and to make this weight selection with smaller weight increments than heretofore has been possible. In addition to the time-saving convenience feature, a further advantage is that the weight trainer can train more scientifically, by virtue of small weight increments. This invention enables the weight trainer to quickly select the desired, precise weight and to easily attach this weight to barbells or other weightlifting equipment.

22 Claims, 2 Drawing Sheets

VARIABLE ADD-ON WEIGHT DEVICE

BACKGROUND OF THE INVENTION

This invention relates to weight training and, in particular, to a means to add on precise variable weights in a manner that is quick and easy. This device can be used on all manner of weight training equipment, including barbells, dumbbells, or training stations such as universal or Nautilus machines. This device can be attached to the weight equipment in any number of ways, including hanging, sliding, snap-on, or stacking. It can be used to select a desired weight over a range divided into small increments, or it can be used to more conveniently select a desired weight over a range divided into larger increments.

One of the earliest efforts to vary add-on weights is the invention of Pelletier et al. (U.S. Pat. No. 850,964), which requires a specially constructed dumbbell with hollow ends for receiving weights. Hall (U.S. Pat. No. 1,779,594) provides for slotted barbell weights which snap, one at a time, onto segments of the bar, which segments have rectangular cross sections. Bender (U.S. Pat. No. 3,758,109) provides for add-on weights in the form of longitudinal bars inside a hollow, cylindrical bar.

The invention of Waitz (U.S. Pat. 4,593,903) comprises concentric tubes with end caps. The invention of Speyer (U.S. Pat. Nos. 3,771,785 and 3,825,253) consists of canted, slotted disc weights which can be individually mounted on the side of a bar, rather than slid in from the bar's end. Inoue (U.S. Pat. No. 4,021,040) has an invention consisting of a variable-weight globe which is screwed onto both ends of a specially constructed dumbbell. Ionel (U.S. Pat. No. 4,076,236) provides for a threaded dumbbell onto which hollow discs can be screwed one at a time. Most of the weight variation is achieved by filling these hollow discs with heavy material, after which they must be weighed. This invention is intended for travel, in that the dumbbells are light when empty for transportation, and can be filled later for adding on weight. This arrangement would not, however, be convenient for everyday use in a gym. A similar invention to that of Ionel is that of Schook (U.S. Pat. No. 4,566,690) which provides for several very heavy disc weights to be screwably attached, one at a time, to a collar mounted on a conventional dumbbell bar. This has the disadvantage of a high probability of stripping threads when mounting heavy weights.

The above inventions cannot be used on conventional barbell bars, and they do not provide for convenient weight selection.

Other prior art includes Wright U.S. Pat. No. 4,531,728 and Van Derworp U.S. Pat. No. 4,743,016. The first of these provides for a single pair of add-on weights which is held on a barbell with the hands of the weight lifter. There is no provision to conveniently select weights over a range of values, and there is no provision to attach the add-on weight to the barbell without using one's hands. The second of these provides for tubular members which can be weighted with lead shot and which can be screwably attached to one another for added weight. This second invention is intended for rehabilitation exercise where the weights change slowly over time, and where one arm or leg may be stronger than the other. It is not intended for conventional weight training in that it cannot easily be attached to barbells or weight equipment and the weight cannot be instantly and accurately changed after each exercise. In short, it is very distinct from my invention, both in structure and in function.

The invention of Hettick (U.S. Pat. No. 4,529,198) utilizes an open-sided box which picks up a portion of a stack of unit weights, as selected by a pointer, from a stand. This invention would be inconvenient and impractical in use because of the unnecessary bulkiness of the box and stand. That is, the invention of Hettick does lend itself to application with barbells, dumbbells, or conventional weight training equipment, as there is no convenient method of attachment of the add-on weight to a barbell or dumbbell. And, it would be problematical to fit the aforementioned box into the housing of weight-training equipment such as Universal machines. Another drawback is that the design and construction of the invention of Hettick is unnecessarily complex, resulting in a probable high cost of production.

My invention is intended to solve certain problems inherent in weight training. It is a somewhat onerous process to gather the various weights needed to arrive at a particular weight on a barbell. Also, the smallest weight increment is typically 5 pounds. This means that the person training with the weights must change the number of repetitions, sometimes substantively, when increasing weight. This can be a serious problem when power lifting with a small number of repetitions, because the weight lifter tends to get stuck at a plateau in terms of the weight being lifted. Furthermore, even if small incremental weights were available it would be inconvenient to count and keep track of them.

What is needed is a way to instantly select first the approximate desired weight, say 155 pounds, and then a precise add-on, say 3.25 pounds. The other need is a means to conveniently and yet easily attach both of these kinds of add-on weights to the barbell or weight equipment.

OBJECTIVES

To allow the weight lifter to train more scientifically because of the capability to change weight in smaller increments.

To make the task of selecting and changing weights quicker and easier, for medium-size weight change increments as well as for small increments.

To create a more attractive product by virtue of markings on the add-on weights which can be decorative as well as functional.

DESCRIPTION

The basic idea of this invention is to have a stack of weight pieces or units which stick together, but which can be easily separated into two parts, one of which is the add-on weight. For example, a 5 pound stack might consist of 20 quarter-pound pieces. Then, one could select any weight between 0.25 and 5.0 pounds, simply by separating the stack at the appropriate location.

A second feature of this invention is a means to keep all of the weight units aligned with each other. This makes possible a third feature, which is the attachment of the add-on weight to the barbell or weight equipment. Finally, a marking pattern enables the weight trainer to easily select the desired add-on weight. In the example of the 5-pound stack of 20 quarter-pound weight units, the first four pieces could be red, the next four yellow, the next four green, the next four blue, and the last four violet. Then, separation at the next to last blue weight unit would instantly give an add-on weight of 3.75 pounds.

In summary, the four main features of this invention are means to (1) stick weight units together, (2) align weight units (3) attach the add-on weight to a barbell, and (4) mark weight units for add-on weight selection.

Figure 1:
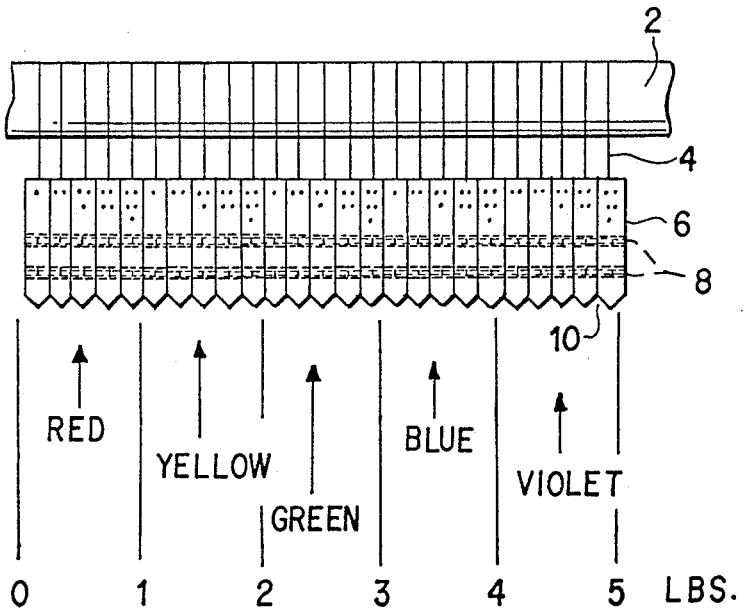
FIG. 1 is a front view of the first embodiment of the invention showing the part of the add-on weight stack which is hung on a barbell.
Figure 2:
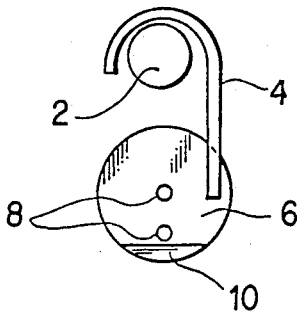
FIG. 2 is an end view of the first embodiment of the invention showing the part of the add-on weight stack which is hung on a barbell.

FIG. 1 is a side view, and FIG. 2 an end view, of the first embodiment of the invention. This embodiment is designed to be hung from a barbell. Bar 2 represents a barbell from which the add-on weight stack composed of weight units 6 are hung, by hangars 4. Weight units 6, and their hangars 4, are maintained in alignment by alignment pins 8. Note that there are two alignment pins 8 for each weight unit 6, in order to ensure alignment. At one end, and on both sides of each weight unit, grip grooves 10 make it easier to separate the initial weight stack at the desired location, in order to select the desired add-on weight. In the example of FIG. 1, one-pound increments are indicated by a color change and 0.2-pound increments are indicated by dots (one to five) on the outside edge of each weight unit.

An important feature of this invention is for the individual weight units 6 to reliably stick to their neighboring weight units 6, while the add-on weight stack is being mounted on the barbell or weight equipment. This can be accomplished in many ways. Each weight unit 6, or a part of each weight unit 6, can be magnetized, or covered with hook and loop fasteners. Or alignment pins 8 can have a snap feature themselves, preventing each weight unit 6 from separating from its neighbors. This "sticking together" feature must be strong enough for the stack to stick together while the add-on weight is being mounted, but weak enough for the initial add-on weight stack to be easily pulled apart at the desired location.

Figure 3:
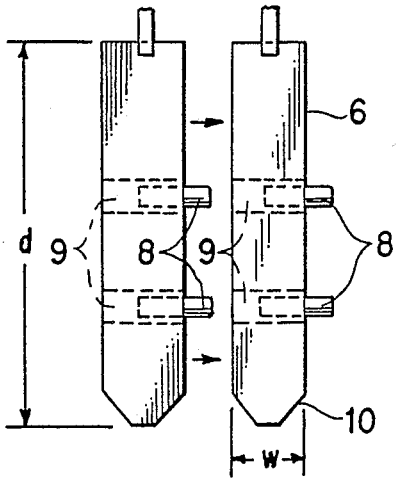
FIG. 3 is a front view of the first embodiment of the invention showing detail of the stack alignment means.

FIG. 3 is a front view of the first embodiment of this invention showing detail of alignment pins 8, which are fixably attached in bore holes 9. These alignment pins stick out on one side so as to fit into bore holes 9 of the next weight unit 6. This can be a snap attachment. FIG. 3 also shows grip grooves 10 in more detail.

Figure 4:
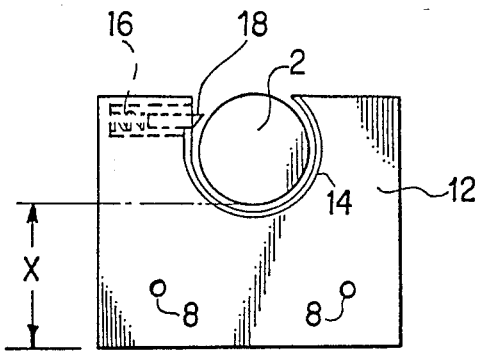
FIG. 4 is an end view of the second embodiment of the invention showing how each piece of the add-on weight stack is snapped on a barbell.

FIG. 4 is an end view of the second embodiment of this invention, showing a opening on one side of slotted weight unit 12, for snapping each slotted weight unit 12 onto bar 2. Snap spring 16 and snap pin 18 ensure the snapping attachment and permit adjustment of the strength of this attachment. The other features of alignment, "sticking together" and weight marking are similar to those of the first embodiment.

One advantage of the second embodiment of the invention is that the add-on weight can be added in the center of a barbell, thereby requiring only one add-on weight rather than a pair. For this application, the shape of weight unit 12 is chosen to minimize x, the extension of weight unit 6 way from bar 2, so that the add-on weight does not interfere with the chest of the weight trainer. With reference to FIGS. 3 and 4, for example, the density and thickness, w, of weight unit 6 can be made large to minimize d or x. Or, the shape of slotted weight unit 12 in FIG. 4 can be circular or elliptical to keep weight unit 6 from sticking out too far from bar 2.

Another way to minimize interference between the weight trainer's chest and the add-on weight uses weight unit liner 14 to provide friction between slotted weight unit 12 and bar 2—so slotted weight unit 12 cannot rotate around bar 2. Then an elliptical or rectangular shape of slotted weight unit 12, used in combination with the proper orientation of slotted weight unit 12 on bar 2, serves to minimize the extent to which the add-on weight interferes with the chest of the weight trainer. Or, orientation of the opening in FIG. 4 toward the weight trainer's chest could completely eliminate such interference.

Figure 5:
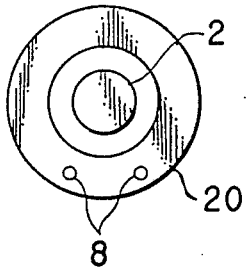
FIG. 5 is an end view of the third embodiment of the invention showing how each piece of the add-on weight stack can be slid on a barbell.

FIG. 5 is an end view of the third embodiment of the invention, in which collar weight unit 20 is slid over bar 2. The advantages here are simplicity of construction and the capability to attach large weights, for example, up to 25 pounds. Thus, this embodiment may be used for heavier add-on weights, as well as for finely incremented add-on weights. The alignment feature is not needed unless a snap version of alignment pins is used to stick each weight unit 20 to its neighbor. That is, the alignment feature will not be needed when Velcro and loop fastners magnetism, or cylindrically symmetric snapping means are used to stick collar weight units 20 together. The marking feature is similar to that of the earlier embodiments of the invention.

Figure 6:
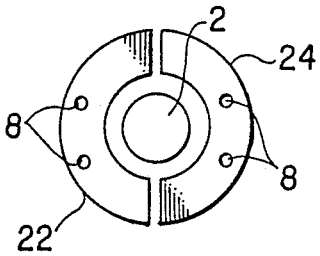
FIG. 6 is an end view of the fourth embodiment of the invention showing how each piece of the add-on weight stack can be mounted on a barbell.

FIG. 6 is an end view of a fourth embodiment of the invention in which first hemispherical weight unit 22 is attached to second hemispherical weight unit 24 around bar 2. This attachment, can be accomplished with magnets, hook and loop fasteners or snaps. This allows the add-on weight unit to be put in the middle of a barbell. Alternatively, the first and second hemispherical weights units can be attached at one end with a hinge, making it easier to handle these weight units.

Figure 7:
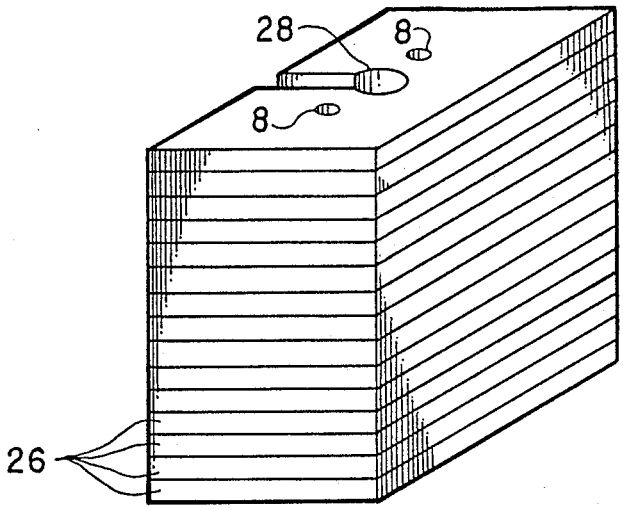
FIG. 7 is a perspective view of the fifth embodiment of the invention showing a stack of add-on weights which can be set on weight training equipment.

FIG. 7 shows a simple stack of stack weight units 26, designed to be set on weight equipment such as UNIVERSAL or NAUTILUS brand weight lifting machines. This simplifies the attachment of the add-on weight unit, but some additional features may be necessary for the idea to work. Usually, this type of exercise equipment has a center rod which aligns the weights on the machine. In this case, slot 28 permits the placement of the add-on weight on the resident weight stack. In addition, the resident weights often have a top surface which is not flat. This means that the bottom of the add-on weight must conform to this top surface, so that the add-on weight will rest securely on the resident weight. Finally, the cross-sectional area of the add-on weight is arbitrary, except to the extent that access of the add-on weight to the resident weight is allowed.

The various components of the add-on weight units may be made of any material that is sufficiently heavy and durable, such as plastics, metals, metal alloys, or lead. The weight unit may have a hard exterior filled with cheap heavy filler material such as sand or lead shot. The magnetic versions, of course, must have at least some part that is magnetic. The snap features both for stick-together of individual weight units and for attachment of weight units to a bar may based be any of many conventional designs.

The above description shall not be construed as limiting the ways in which this invention may be practiced but shall be inclusive of many other variations that do not depart from the broad interest and intent of the invention.

Having thus described the invention, what is claimed as new and desired to be secured by Letters Patent is:

1. A variable add-on weight device comprising a plurality of weight units, each of which includes a coupling means for directly attaching said weight unit to an adjacent weight unit, at least one of said weight units defining a first add-on weight stack and the remaining weight units defining a second add-on weight stack, wherein (a) adjacent weight units in said first add-on weight stack are directly coupled by said coupling means when said first add-on weight stack comprises more than one of said weight units, (b) adjacent weight units in said second add-on weight stack are directly coupled by said coupling means when said second add-on weight stack comprises more than one of said weight units and (c) said first add-on weight stack is directly coupleable by said coupling means to said second add-on weight stack.

2. The variable add-on weight device of claim 1 further comprising alignment means for aligning adjacent weight units.

3. The variable add-on weight device of claim 2 wherein said alignment means in each of said weight units comprises a bore hole and an alignment pin fixably attached in said bore hole and extending from the mid-portion of said bore hole out one end of said bore hole, whereby said extended portion is engageable with the bore hole of said adjacent weight unit for aligning said adjacent weight units.

4. The variable add-on weight device of claim 1 further comprising attachment means for attaching said first add-on weight stack to a weight lifting bar or weight training device.

5. The variable add-on weight device of claim 4 wherein said attachment means comprises a plurality of hangars.

6. The variable add-on weight device of claim 4 wherein said attachment means comprises a plurality of access slots in each of said weight units for allowing said weight units to slide around a barbell or dumbbell and snaps for attaching said weight units to said bar.

7. The variable add-on weight device of claim 4 wherein said attachment means comprises a plurality of collar-shaped weight units for sliding onto a bar such as a barbell or a dumbbell.

8. The variable add-on weight device of claim 4 wherein said attachment means comprises a plurality of pairs of hemispherical half-collars which releasably attach to each other around a barbell wherein said pairs of hemispherical half-collars are attachable to the center of said barbell.

9. The variable add-on weight device of claim 8 wherein each of said pairs of hemispherical halfcollars are hingebly attached on one end.

10. The variable add-on weight device of claim 4 wherein said attachment means comprises a stacked plurality of weights, each of which has indentations on one side and protrusions on the opposite side whereby each said indentation is nestable with said protrusion and whereby said indentation and said protrusion are nestable with the weights on other weight training equipment.

11. The variable add-on weight device of claim 10 wherein said nestable shape comprises a slot for allowing said stack of weight units to fit around the center rod passing through the center of said weights of said weight training equipment.

12. The variable add-on weight device of claim 10 wherein said nestable shape comprises recesses in the bottom surface of said add-on weights units, whereby said stack of weight units rests securely on the top of said weights on said other weight training equipment.

13. The variable add-on weight device of claim 1 further comprising marking means for indicating the weight of said selected add-on weight stack.

14. The variable add-on weight device of claim 13 wherein said marking means comprises a color code to indicate the amount of weight on said selected add-on weight stack.

15. The variable add-on weight device of claim 13 wherein said marking means comprises a pattern which indicates the amount of weight on said selected add-on weight stack.

16. The variable add-on weight device of claim 14 wherein said marking means comprises patterns of dots or bars which indicate the amount of weight on said selected add-on weight stack.

17. The variable add-on weight device of claim 14 Wherein said marking means comprises decorative patterns which indicate the amount of weight on said selected add-on weight stack.

18. The variable add-on weight device of claim 13 wherein said marking means comprises numbers which indicate the amount of weight on said selected add-on weight stack.

19. The variable add-on weight device of claim 1 wherein said coupling means attaches adjacent ones of said weight units together magnetically.

20. The variable add-on weight device of claim 1 wherein said coupling means attaches adjacent ones of said weight units with hook and loop fasteners.

21. The variable add-on weight device of claim 1 wherein said coupling means attaches adjacent ones of said weight units together with snaps.

22. The variable add-on weight device of claim 1 wherein said stack separation means further comprises grip grooves at one end of each weight unit for easier separation of said initial add-on weight unit into said selected add-on weight stack and said remainder weight stack.

* * * * *